US005975380A

United States Patent [19]

West, Jr.

[11] Patent Number: 5,975,380

[45] Date of Patent: Nov. 2, 1999

[54] CONTAINER INCLUDING AN ACCORDION LIKE POURING SPOUT

[76] Inventor: Roy A. West, Jr., 3012 Old Gate Ct., Morehead, N.C. 28557

[21] Appl. No.: 09/033,103

[22] Filed: Mar. 2, 1998

[51] Int. Cl.[6] ..... B67D 5/06

[52] U.S. Cl. ..... 222/529; 222/530; 222/541.1

[58] Field of Search ..... 222/529, 530, 222/541.1

[56] References Cited

U.S. PATENT DOCUMENTS

| | | | |
|---|---|---|---|
| 4,095,728 | 6/1978 | Chlystun | 222/529 |
| 4,236,655 | 12/1980 | Humphries | 222/530 X |
| 4,351,545 | 9/1982 | Maynard, Jr. | 222/529 X |
| 4,583,668 | 4/1986 | Maynard, Jr. | 222/529 |
| 4,817,832 | 4/1989 | Nagy | 222/530 |
| 4,893,734 | 1/1990 | Chlystun | 222/529 X |
| 4,901,878 | 2/1990 | Humphries | 222/530 X |
| 5,088,632 | 2/1992 | Odet et al. | 222/529 |
| 5,133,481 | 7/1992 | Mayfield | 222/529 X |
| 5,170,910 | 12/1992 | Hamm | 222/527 |
| 5,505,308 | 4/1996 | Young et al. | 222/529 |
| 5,722,570 | 3/1998 | Sultzer, III et al. | 222/529 |

*Primary Examiner*—Kenneth Bomberg
*Attorney, Agent, or Firm*—Michael I. Kroll

[57] ABSTRACT

A container for use in dispensing a substance contained therein. The container includes a body section and closure cap. The body section includes a top side having a recess extending therethrough and a pouring spout connected to and extending from the top side so as to cover the recess. The pouring spout includes a body section having a crease spiraling therearound. The closure cap includes a top side, a skirt depending from the top side having an inner side and a thread spiraling around the inner side of the skirt. The pouring spout is movable between a first compressed position and a second expanded position. In the first compressed position the crease forms a thread extending around the pouring spout for engaging the thread spiraling around the inner side of the skirt to seal the container closed. In the second expanded position the pouring spout is in an extended state reaching a distance above the top side eliminating the thread spiraling therearound formed by the compression and preventing connection with the closure cap.

16 Claims, 6 Drawing Sheets

CONTAINER INCLUDING AN ACCORDION LIKE POURING SPOUT

BACKGROUND OF THE INVENTION

1. Field of the Invention

The present invention relates generally to receptacles for retaining a substance therein and, more specifically, to a disposable container having an extendable and adjustable accordion like pouring spout.

2. Description of the Prior Art

Numerous receptacles adapted to hold various substances have been provided in prior art For example, U.S. Pat. Nos. 4,492,324 and 4,696,328 are illustrative of such prior art. While these units may be suitable for the particular purpose to which they address, they would not be as suitable for the purposes of the present invention as heretofore described.

A container is disclosed which is suitable for liquids having a flexible neck integral with the container which can be flexed to a flexed position and retained in that position. This allows the container to be used for filling inaccessible filler holes on motor vehicles and the like. The flexible neck portion has a smaller cross sectional area than the container. The neck comprises a plurality of specially shaped accordion ribs extending for at least a part of the length of the neck portion such that an integral pouring spout at the end of the neck portion can be flexed to a flexed position from an upright position to accommodate pouring and generally retain the flexed position, the spout having cap supporting means thereon.

A bottle that can be used for preventing spillage when the bottle is tilted for positioning the bottle so that all of the liquid therein is received by an intended receptacle for the liquid. The bottle is made of a flexible material that may be squeezed to decrease the interior volume of the bottle, and has an elongated neck terminating in an opening that is wide enough to enable viscous liquid to pour freely therethrough from the bottle when the bottle is tilted. An airtight seal is secured to the perimeter of the neck and closes the opening for preventing liquid from being poured from the opening when the bottle is tilted; and the seal is rupturable upon pressure being exerted thereon by the contents of the bottle when the container is squeezed. In order to prevent the seal from being ruptured during handling of the bottle prior to such time as it is desired to pour the liquid from the bottle, a cap is fitted over the opening of the bottle and contacts the seal to counteract any pressure applied against the seal as a result of the squeezing the bottle and thereby prevents the seal from being ruptured.

SUMMARY OF THE PRESENT INVENTION

The present invention relates generally to receptacles for retaining a substance therein and, more specifically, to a container having an extendable and adjustable accordion like pouring spout.

A primary object of the present invention is to provide a container having an accordion like pouring spout that will overcome the shortcomings of prior art devices.

A further object of the present invention to provide a container having an accordion like pouring spout which is movable between a first compressed position and a second expanded position.

An even further object of the present invention to provide a container having an accordion like pouring spout wherein a thread is formed in said pouring spout for engaging a thread on a closure cap when said pouring spout is in said first compressed position.

A still further object of the present invention to provide a container having an accordion like pouring spout which is both extendable and adjustable.

Another feature of the present invention is to provide a container having an accordion like pouring spout including a sealing device made of a thin piece of non-porous material affixed about the mouth section.

Still another feature of the present invention is to provide a container having an accordion like pouring spout wherein the thin piece of non-porous material can be broken and removed to allow the substance to be poured therethrough.

Another feature of the present invention is to provide a container having an accordion like pouring spout having any of a number of desired lengths.

Still another feature of the present invention is to provide a container having an accordion like pouring spout forming an integral relationship with the body portion of the container.

Yet still another feature of the present invention is to provide a container having an accordion like pouring spout wherein both the accordion like pouring spout and the body portion of the container are fabricated of a durable plastic material.

Still yet another feature of the present invention is to provide a container having an accordion like pouring spout which is able to hold various amounts of a substance and is formed in any of a number of various sizes and colors.

Another feature of the present invention is to provide a container having an accordion like pouring spout which can be flexed to any position possible and is biased to remain in its compressed position when at rest.

Yet another feature of the present invention is to provide a container having an accordion like pouring spout that is made from any of rigid and flexible polyvinyl chloride resins with or without additives, polyesters, copolyesters, polypropylene, polycarbonates, acrylics such as ABC and nitrites and other suitable resins or mixtures thereof.

Still another feature of the present invention is to provide a container having an accordion like pouring spout that is made from one of high and low density polyethylene.

Additional objects of the present invention will appear as the description proceeds.

A container for use in dispensing a substance contained therein is disclosed by the present invention. The container includes a body section and closure cap. The body section includes a top side having a recess extending therethrough and a pouring spout connected to and extending from the top side so as to cover the recess. The pouring spout includes a body section having a crease spiraling therearound. The closure cap includes a top side, a skirt depending from the top side having an inner side and a thread spiraling around the inner side of the skirt. The pouring spout is movable between a first compressed position and a second expanded position. In the first compressed position the crease forms a thread extending around the pouring spout for engaging the thread spiraling around the inner side of the skirt to seal the container closed. In the second expanded position the pouring spout is in an extended state reaching a distance above the top side eliminating the thread spiraling therearound formed by the compression and preventing connection with the closure cap.

The novel features which are considered characteristic for the invention are set forth in particular in the appended claims. The invention itself, however, both as to its construction and its method of operation, together with additional objects and advantages thereof, will be best understood from the following description of the specific embodiments when read in connection with the accompanying drawings. It is to be realized, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

Figure 5:
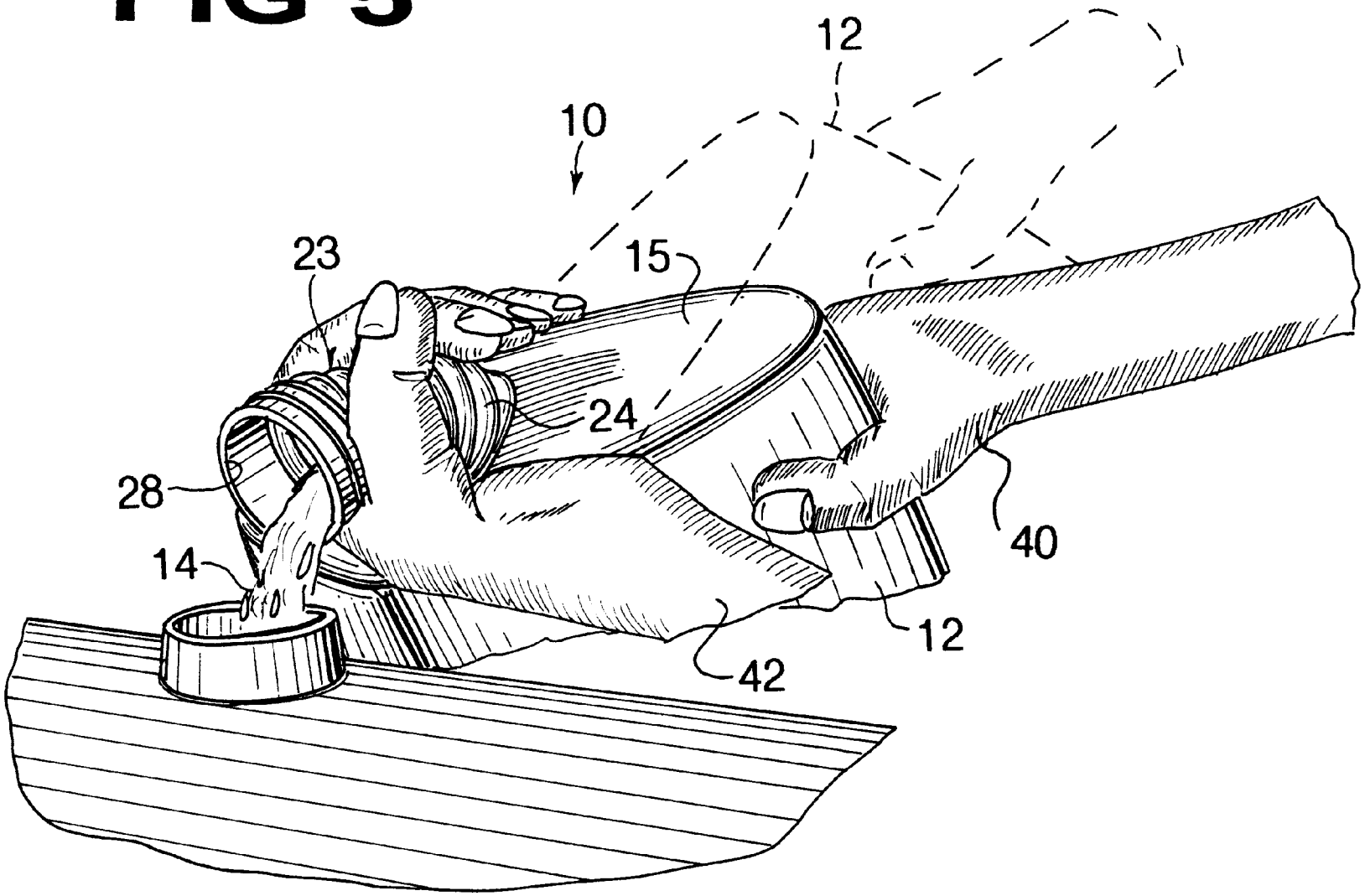
Figure 6:
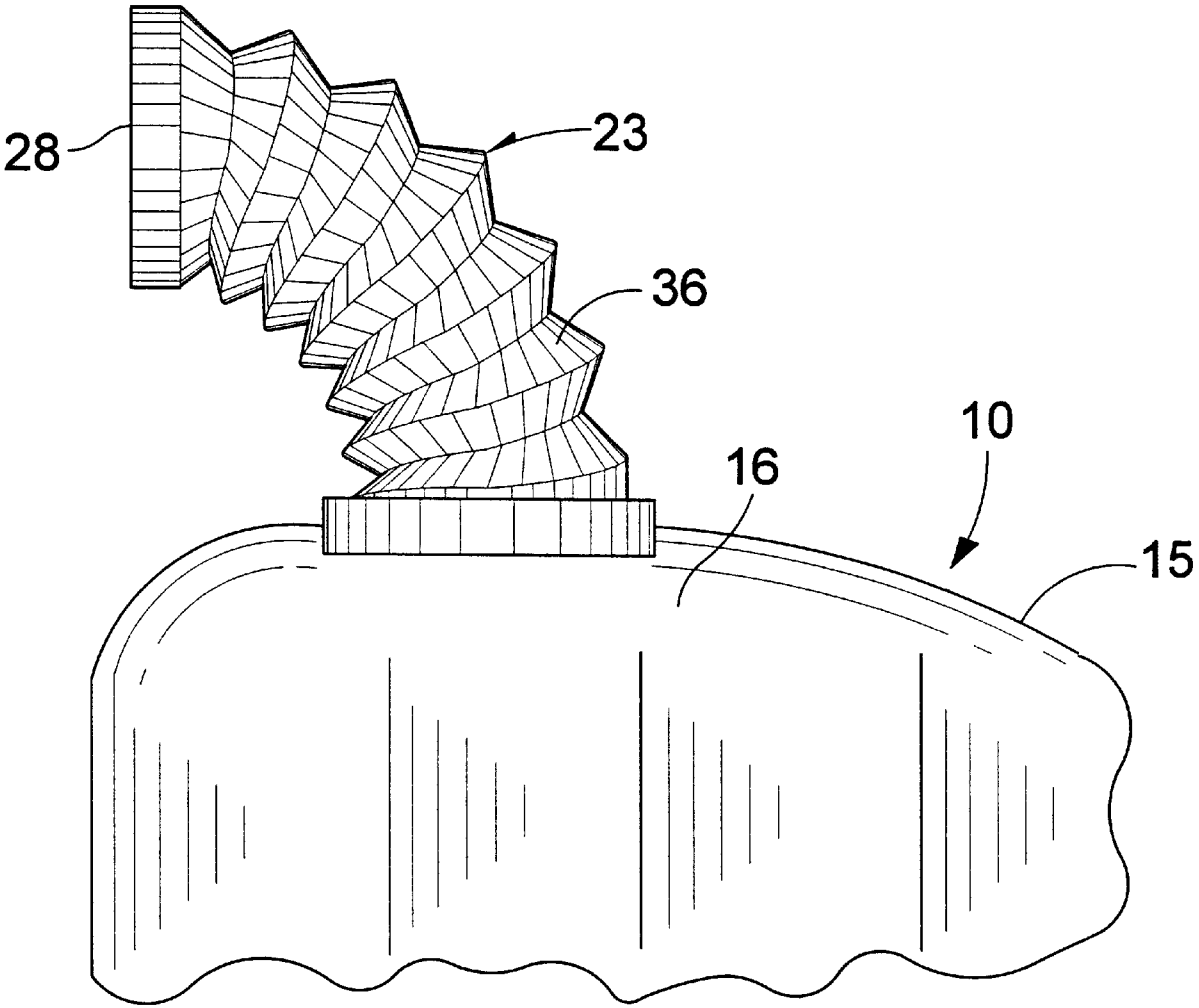

FIG. 5 is a perspective view of the upper portion of the container having an accordion like pouring spout of the present invention showing the pouring spout in an extended adjustably bent condition being used to pour a liquid therefrom; and FIG. 6 is a side perspective view of the container having an accordion like pouring spout of the present invention showing the pouring spout in an extended adjustably bent condition.

DESCRIPTION OF THE REFERENCED NUMERALS

Turning now descriptively to the drawings, in which similar reference characters denote similar elements throughout the several views, the Figures illustrate the container having an accordion like pouring spout of the present invention. With regard to the reference numerals used, the following numbering is used throughout the various drawing figures.

10 container having an accordion like pouring spout of the present invention

12 body portion

14 substance

15 top side of body portion

16 recess in top side of body portion

17 pouring spout

18 membrane

20 closure cap

22 body section of pouring spout

23 crease in body section of pouring spout

24 thread formed by compression of pouring spout

26 inner side of closure cap

28 mouth in pouring spout

30 membrane/seal

32 top side of closure cap

34 skirt extending from top side of closure cap

36 thread extending around inner side of closure cap

38 accordion like pouring spout in expanded position

40 first hand of person dispensing substance

42 second hand of person dispensing substance

DETAILED DESCRIPTION OF THE PREFERRED EMBODIMENT

Turning now descriptively to the drawings, in which similar reference characters denote similar elements throughout the several views, the Figures illustrate a container having an accordion like pouring spout in accordance with the present invention. The container is indicated generally by the numeral 10.

The container 10 of the present invention includes a body section 12 for holding and retaining a substance 14 therein. The body section 12 is hollow and may be formed in any desired shape and size for retaining any desired amount of substance therein. The substance 14 may be in any of liquid, solid and gaseous form. On a top side 15 of the body section 12 and extending therethrough is a recess 16 for use in inserting and removing the substance 14 therefrom. Extending from the recess 16 is a pouring spout 17 for aiding in removal and pouring of the substance 14 out from the body section 12.

The pouring spout 17 is hollow and integrally connected with the top side 15 of the body section 12. The pouring spout 17 is also positioned to fully cover the recess 16 and includes an open mouth 28 for dispensing of the substance 14 therethrough. A membrane 18 is removably positioned on a side of the pouring spout 17 opposite the connection with the top side 15 for sealing the mouth 28 of the pouring spout 17 and thereby preventing accidental leakage of the substance 14 from the body section 12 and through the mouth 28 of the pouring spout 17 prior to initial use of and dispensing of the substance 14 from the container 10. A closure cap 20 is also provided for removably covering the pouring spout 17 and thereby preventing foreign matter, such as dirt, dust, etc., from entering the body section 12 through the pouring spout 17 after the membrane 18 has been removed from its position sealing the pouring spout 17.

The pouring spout 17 is preferably formed of a hollow accordion like tube allowing for the extension and compression of the pouring spout 17 from its position on the top side 15 of the body portion 12. The pouring spout 17 includes an extended body section 22 with a crease 23 spiraling therearound. When the pouring spout 17 is compressed, the body section 22 of the pouring spout 17 folds along the crease 23 spiraling therearound. In this compressed position the body section 22 is caused to fold along the crease 23 so as to form a thread 24 spiraling around the compressed pouring spout 17. When the pouring spout 17 is expanded, the thread 24 expands with the body section 22 and eventually disappears, the crease 23 however remains visible. The single crease 23 spiraling around the body section 22 of the pouring spout 17 defines the position at which the thread 24 will form when the pouring spout 17 is compressed. The pouring spout 17 is caused to be biased to bend in one direction in its expanded position due to the form of the pouring spout required to form the thread spiraling therearound in its compressed position. When the pouring spout 17 is extended from its compressed, at rest position the body section 12 should be turned so that the biased bending of the pouring spout 17 is directed towards the desired pouring direction. This will allow the substance 14 to be properly directed when poured out from the body section 12. The pouring spout 17 is normally biased to remain in its compressed position at rest.

Figure 4:
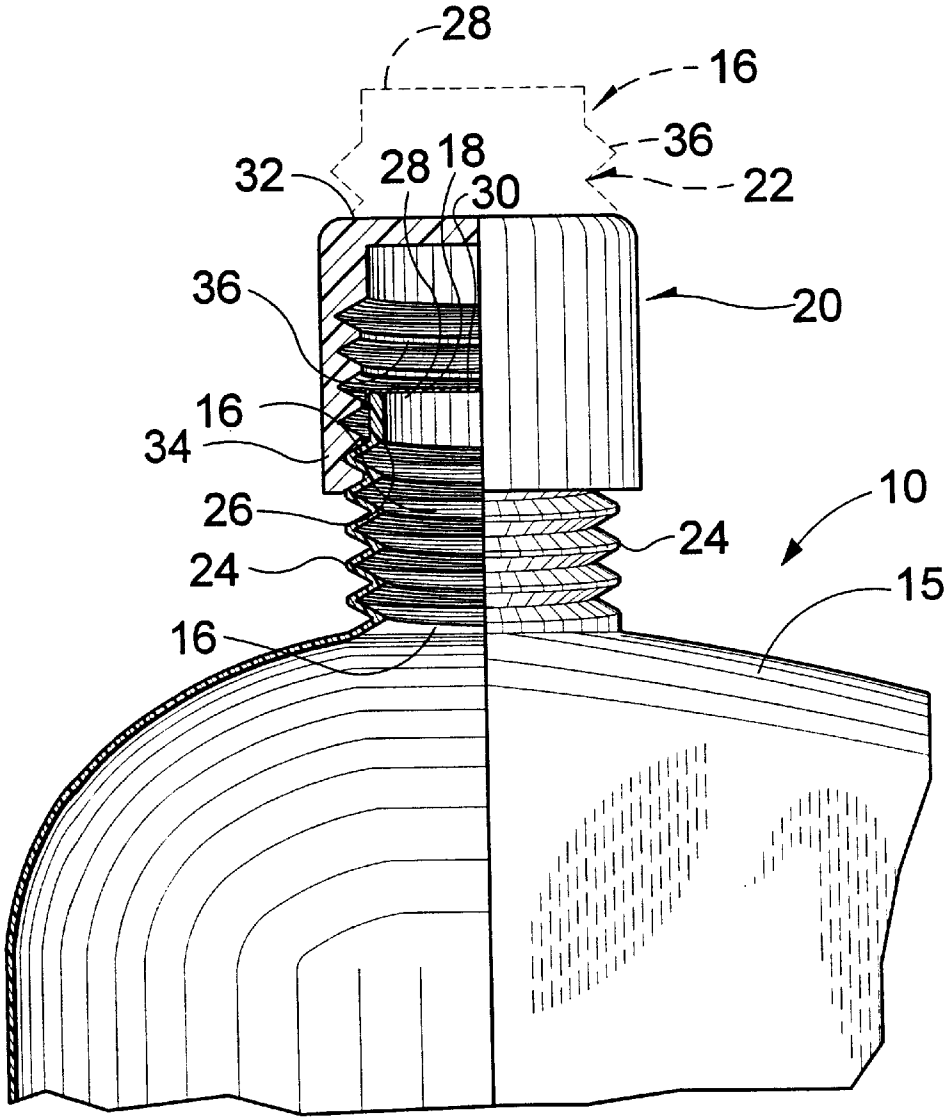
FIG. 4 is a front view with parts broken away and in partial cross-section of the upper portion of the container taken along the line 4—4 of FIG. 1 having an accordion like pouring spout of the present invention showing the pouring spout in the compressed sealed position and the cap partially attached thereto.

As can be seen in the cross section illustration of FIG. 4, the closure cap 20 includes a top side 32 and a skirt 34 extending therefrom. Spiraling around an inner side 26 of the skirt 34 is a thread 36. The pouring spout 17 is illustrated in its compressed position for connection to the closure cap 20. When the pouring spout 17 is in its compressed position, the closure cap 20 is connected thereto by placing it over the mouth 28 and turning in a clockwise direction until the thread 36 around the inner side of the skirt 34 engages the thread 24 formed by the compression of the pouring spout 17. In order to remove the closure cap 20 for dispensing of the substance 14 within the body portion 12 of the container 10 the closure cap 20 is turned in the counterclockwise direction to disengage the threads 24 and 36. The pouring spout 17 can now be expanded to extend from the top side 15 a distance equal to its length thereby easing the dispensing of the substance 14 therefrom. When the closure cap 20 is secured to the pouring spout 17 the pouring spout 17 is prevented from being moved into the extended position.

The container 10 may be made from any one of rigid and flexible polyvinyl chloride resins with or without additives, polyesters copolyesters, polypropylene, polycarbonates, acrylics such as ABC, and nitrites and other suitable resins or any combination thereof that can be molded. The container 10 may also be made from high or low density polyethylene, and be formed in any desired shape, size or color.

The membrane 18 is preferably made of a thin piece of non-porous material affixed about the mouth 28 of the pouring spout 17, whereby the material 30 can be broken and removed to allow the substance 14 to be poured therethrough. The closure cap 20 includes an internal thread 36 for engaging with the external thread 24 formed by the compression of the pouring spout 17.

Figure 1:
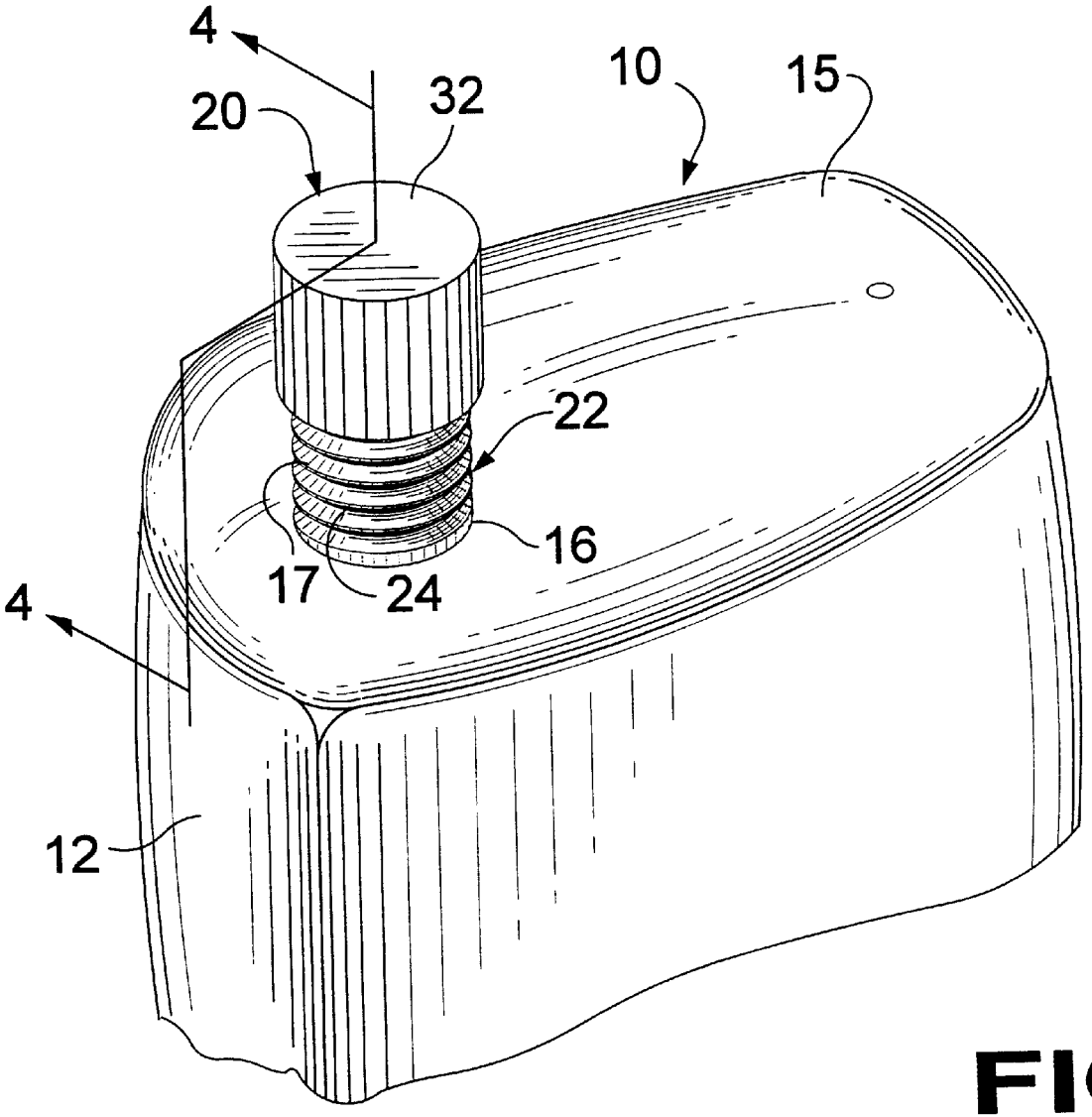
FIG. 1 is a perspective view of the upper portion of the container having an accordion like pouring spout of the present invention showing the pour spout in a compressed state with a cap partially engaged with the pour spout.
Figure 2:
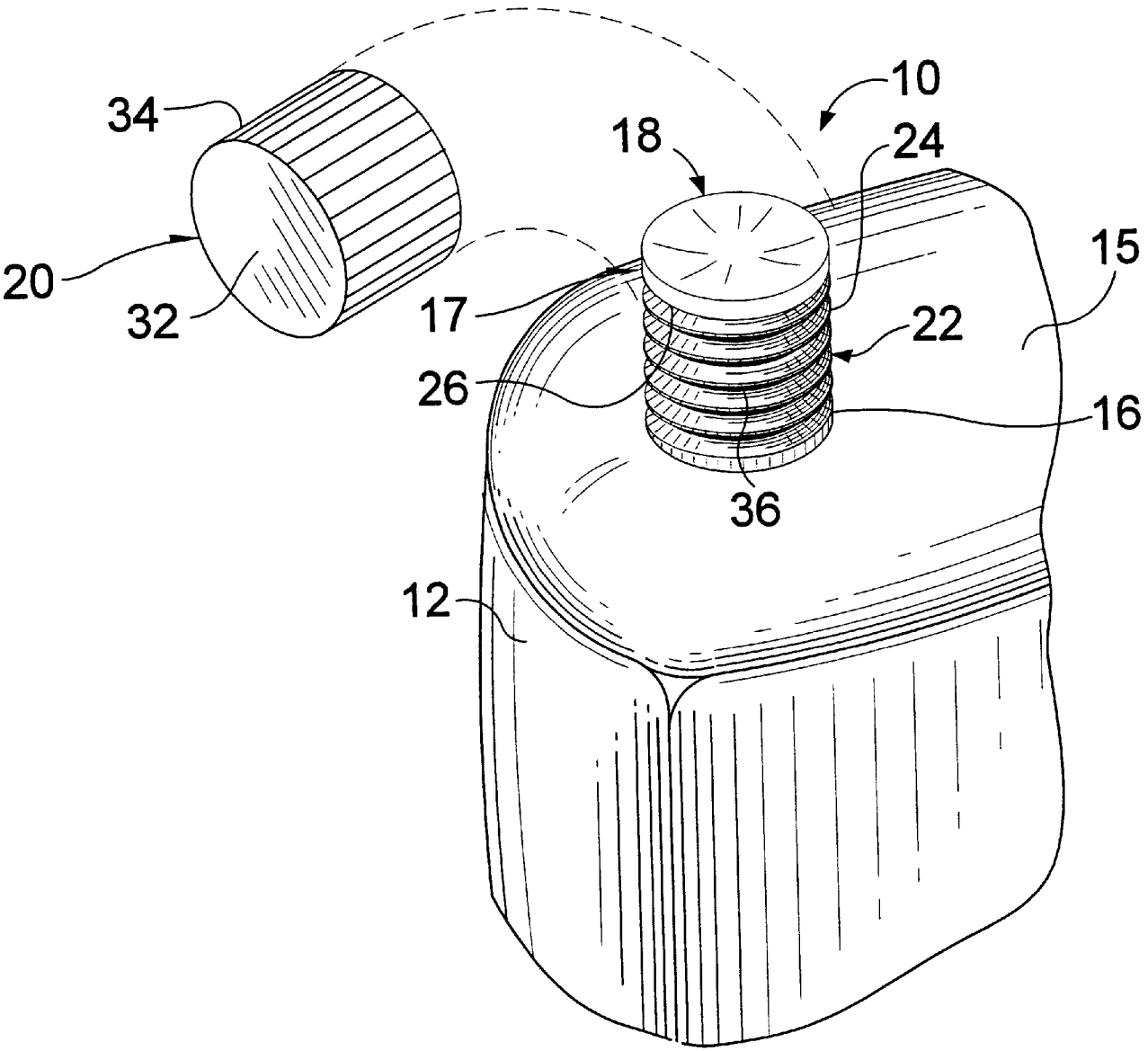
FIG. 2 is a perspective view of the container having an accordion like pouring spout of the present invention similar to FIG. 1 with the cap removed therefrom.
Figure 3:
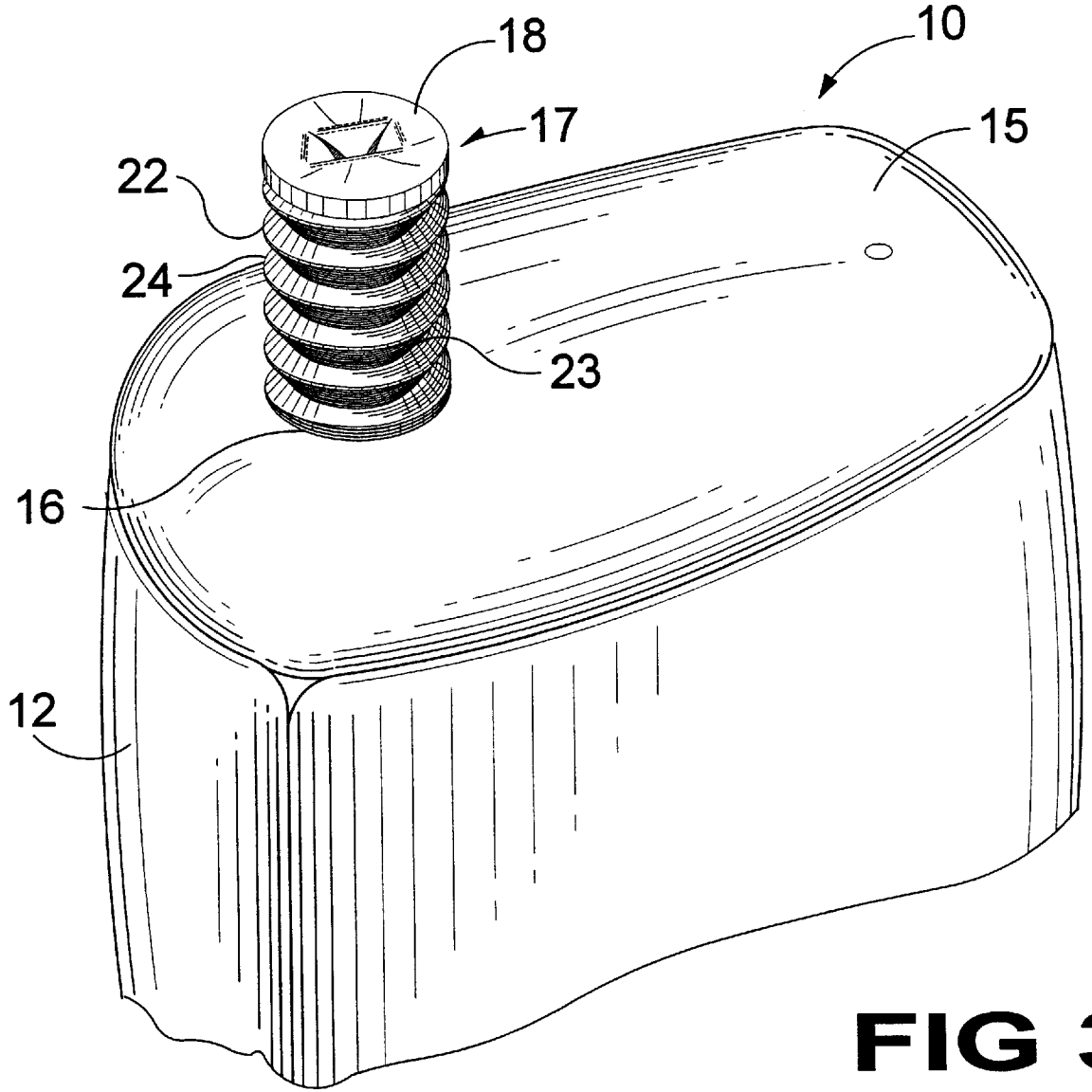
FIG. 3 is a perspective view of the container having an accordion like pouring spout of the present invention similar to FIG. 2 showing the cap removed, the seal broken and the accordion like pouring spout in a partially extended position.

FIG. 1 illustrates the container 10 of the present invention with the pouring spout 17 in its compressed position and the closure cap 20 secured thereto. FIG. 2 shows the closure cap 20 removed from its sealed position of FIG. 1 to reveal the membrane 18 covering the mouth 28 of the pouring spout 17 prior to dispensing of any substance 14 therefrom. Prior to the initial dispensing of the substance the membrane 18 covering the mouth of the spout must be punctured as illustrated in FIG. 3.

Use of the container 10 to dispense the substance 14 contained therein is illustrated in FIGS. 5 and 6. As can be seen in these figures, the pouring spout 17 is in its extended position. The thread 24 extending therearound is eliminated and the crease 23 defining the position on the body section 22 where the thread 24 forms is shown. It is also seen how the body section 22 is biased to bend towards one side. When it is desired to dispense the substance 14 from the container 10 the person dispensing the substance 14 will hold the body portion 12 of the container 10 with one hand 40 and hold the body section 22 of the pouring spout 17 with the other hand 42. The person will then tilt the container 10 in the direction in which the pouring spout 17 bends until a desired amount of the substance 14 is dispensed into the desired receptacle 44. The pouring spout 17 is then compressed whereby the crease 23 will collapse the body section 22 to form the thread 24 spiraling therearound. The closure cap 20 will then be placed atop the mouth 28 of the pouring spout 17 and turned in a clockwise direction. The thread 36 on the inner side 34 of the closure cap 20 will be caused to engage the thread 24 formed around the pouring spout 17 to seal the mouth 28 closed and prevent the substance 14 from being dispensed. In this position the pouring spout 17 will be prevented from moving into its extended position.

This type of pouring spout aids a person in eliminating spillage of the substance being dispensed as the pouring spout can be expanded prior to dispensing such that it is placed against the receptacle. This will eliminate spillage caused by tilting a filled open container towards the receptacle during dispensing. Furthermore, the accordion like pouring spout is neatly contained when the container is not being used as it is forced to remain in its compressed position when the closure cap is engaged therewith.

From the above description it can be seen that the container of the present invention is able to overcome the shortcomings of prior art devices by providing a container having an accordion like pouring spout which is movable between a first compressed position and a second expanded position wherein a thread is formed in said pouring spout for engaging a thread on a closure cap when said pouring spout is in said first compressed position and the pouring spout is both extendable and adjustable. The container may include a sealing device made of a thin piece of non-porous material affixed about a mouth section of the pouring spout of non-porous material which must be broken and removed to allow the substance to be poured therethrough prior to initial use. The accordion like pouring spout and the body portion of the container are fabricated of a durable plastic material and is able to hold various amounts of a substance and is formed in any of a number of various sizes and colors. The accordion like pouring spout which can be flexed to any position possible and is biased to remain in its compressed position when at rest. Furthermore, the container of the present invention is simple and easy to use and economical in cost to manufacture.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A container for use in dispensing a substance contained therein including a body section and a closure cap, said closure cap comprising:

a) a first top side;

b) a skirt depending from said top side having an inner side; and c) a thread spiraling around said inner side of said skirt; and said body section comprising:

d) a second top side having a recess extending therethrough; and e) a spout connected to and extending from said second top side so as to cover said recess, said spout including a body portion including a crease extending therearound, said pouring spout being movable between a first compressed position in which said crease forms a thread extending around said pouring spout for engaging said thread spiraling around said inner side of said skirt to seal said container closed and a second expanded position wherein said pouring spout extends a distance from said top side eliminating said thread spiraling therearound and preventing connection with said closure cap.

2. The container as recited in claim 1, wherein said pouring spout bends towards one side of the container.

3. The container as recited in claim 1, wherein said pouring spout is biased towards its first compressed position.

4. The container as recited in claim 1, wherein said pouring spout is hollow and includes a mouth for dispensing the substance within the container therethrough.

5. The container as recited in claim 4, further comprising a membrane for sealing said mouth prior to dispensing of any substance from said container.

6. The container as recited in claim 5, wherein said membrane is a thin piece of non-porous material affixed about the mouth of said pouring spout.

7. The container as recited in claim 5, wherein said membrane is removably connected to said pouring spout and must be at least partially removed prior to initial dispensing of the substance.

8. The container as recited in claim 1, wherein said pouring spout is an accordion type pleated tube.

9. The container as recited in claim 8, wherein said pleated tube is integrally connected to said second top side.

10. The container as recited in claim 9, wherein said pleated tube and body portion are fabricated out of a durable plastic material.

11. The container as recited in claim 1, wherein said pouring spout is secured in its compressed position when connected with said closure cap.

12. The body section as recited in claim 1, wherein said container is made from at least one of rigid polyvinyl chloride resins, flexible polyvinyl chloride resins, polyesters, copolyesters, polypropylene, polycarbonates, acrylics and combinations thereof.

13. The container as recited in claim 12, wherein said acrylics are one of ABC, nitrites, other suitable resins and mixtures thereof.

14. The container as recited in claim 13, wherein said acrylics are molded.

15. The container as recited in claim 1, wherein said container is made from one of high density polyethylene and low density polyethylene.

16. The container as recited in claim 1, wherein said pouring spout and the body portion are fabricated of a durable plastic material.

* * * * *